United States Patent [19]

Minissian

[11] 4,417,856

[45] Nov. 29, 1983

[54] PERISTALTIC PUMP

[76] Inventor: Kevin G. Minissian, P.O. Box 85C, Pasadena, Calif. 91104

[21] Appl. No.: 296,014

[22] Filed: Aug. 25, 1981

[51] Int. Cl.[3] ..... F04B 43/08

[52] U.S. Cl. ..... 417/477

[58] Field of Search ..... 417/477, 475, 476

[56] References Cited

U.S. PATENT DOCUMENTS 3,507,585 4/1970 Mercer ..... 417/477 X
3,549,279 12/1970 Grach ..... 417/477

FOREIGN PATENT DOCUMENTS 2037572 2/1972 Fed. Rep. of Germany ..... 417/477
1167570 10/1969 United Kingdom ..... 417/477

*Primary Examiner*—Richard E. Gluck
*Attorney, Agent, or Firm*—Paul D. Supnik

[57] ABSTRACT

A peristaltic pump has facing half shells defining a pumping cavity and circular tube access grooves entering the cavity. Rotor apparatus includes a cylinder having concave, semi-spherical end surfaces rotatably supporting roller balls therein. The pumping cavity has a tube supporting substantially semi-annular, semicircular seat. Spring loaded roller bearings in rotor axial bores communicate with the roller balls adjacent the concave surfaces. The roller bearings engage the roller balls urging a central crescent shaped occlusion of the tubing.

In operation, tubing is inserted in the access openings. The impeller rotation and frictional forces transmitted by the roller balls forces the tubing about the semicircular seat and out the opposing access groove. The roller balls impinge the tubing normal to a nominal tube axis to cause an occlusion deforming the tubing to a crescent configuration. As the roller balls traverse a toroidal configuration, the crescent shaped occlusion moves along the tube advancing fluid forward while creating a rearward vacuum.

5 Claims, 6 Drawing Figures

PERISTALTIC PUMP

BACKGROUND OF THE INVENTION

1. Field of the Invention

This invention pertains to fluid pumping apparatus. Particularly, this invention pertains to peristaltic pumps in which a fluid is passed through a flexible tubing by moving occlusions of the tubing.

2. Description of the Prior Art

Peristaltic or tube pumps are used where it is desirable avoid pump contamination by the pumped fluid or contamination of the fluid pumped. They are used for pumping corrosive materials, in laboratories and in medical fields. No fluid contamination occurs since pumped fluid only contacts the insides of the tubing walls. The chemical resistance of the tubing, thus determines the limits of the resistance to contamination.

Rollers are typically used to cause a deformation or occlusion of the tubing which rollers are advanced both to drive the fluid in the tubing forward, while creating a rearward vacuum suction behind the portion of the fluid being pushed forward. Each roller is typically a cylinder. The axis of the cylindrical roller is disposed transversely to the tubing. As the roller bears on the tubing, it exerts forces on the central portion of the tubing, but also causes a flattening of the edges. Ultimately, the tubing must be advanced through the pump to subject a fresh tubing segment to the rollers, or replaced as a result of the frictional forces on the tubing and repeated tubing deformation. Often this is not of significant concern when the pumping is used on an intermittant or occasional basis. However, where the pumping apparatus is fixed in a unit of machinery, it is often desirable to minimize pump maintenance.

SUMMARY OF THE INVENTION

A peristaltic pump in accordance with this invention generally comprises a housing for supporting a flexible resilient tubing. A rotor is disposed within the housing. The impeller has a concave arcuate surface facing and transverse to the tubing. The arcuate surface of the rotor is movable longitudinally to create a moving crescent shaped occlusion. This concave arcuate surface causes the tubing to deform centrally, without exerting significant forces at the edges of the tubing deformity. The limited forces exerted at the flattened sides of the tubing provide an enhanced tubal life while maintaining high flow capacity.

In a more specific example of the invention, the tubing is supported by semi-annular seat of semicircular cross-section within the housing. The rotor comprises a longitudinal shaft having concave spherical surfaces at either end. Roller balls are rotatably disposed within the semi-spherical concave surfaces of the shaft. The roller balls impinge normal to the tubing axis. Thus, rather than flattening the tubing, the tubing is allowed to retain a circular shape on the nonimpacted side of the tubing, while the impacted side of the tubing is pushed into a generally concave circular shape giving the occluded portion of the tubing a crescent configuration.

Additional features in accordance with this invention include longitudinal bores within the shaft for supporting biasing means to urge the roller ball against the tubing. Ball bearings disposed within each of the bores provide low friction rotating surfaces on which the roller balls can rotate. The support grooves have a radius of curvature somewhat greater than the tubing diameter to conform to a greater curvature of the tubing when occluded.

BRIEF DESCRIPTION OF THE DRAWINGS

A better understanding of the invention may be had by reference to the following description taken in conjunction with the accompanying drawings in which.

DETAILED DESCRIPTION

Figure 1:
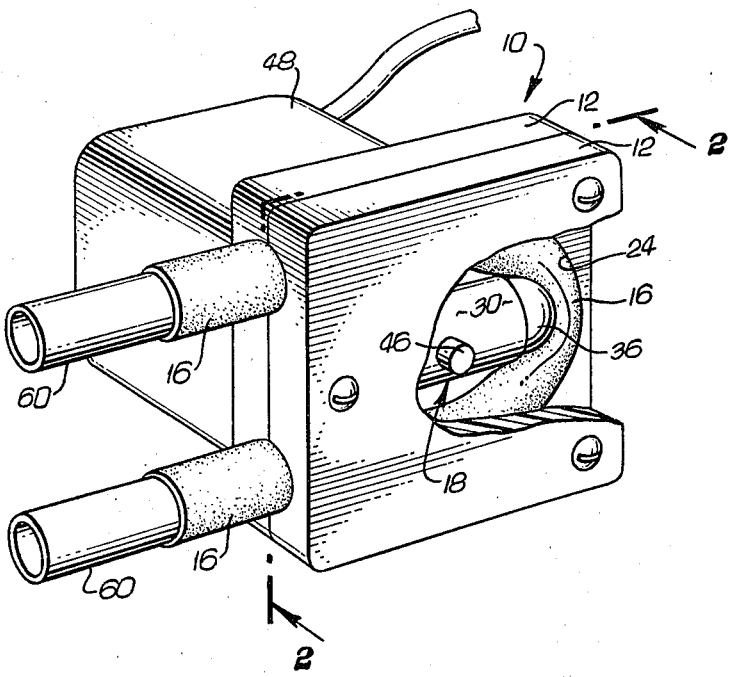
FIG. 1 is a perspective view with portions exposed and portions removed, of an example of a peristaltic pump in accordance with this invention.
Figure 2:
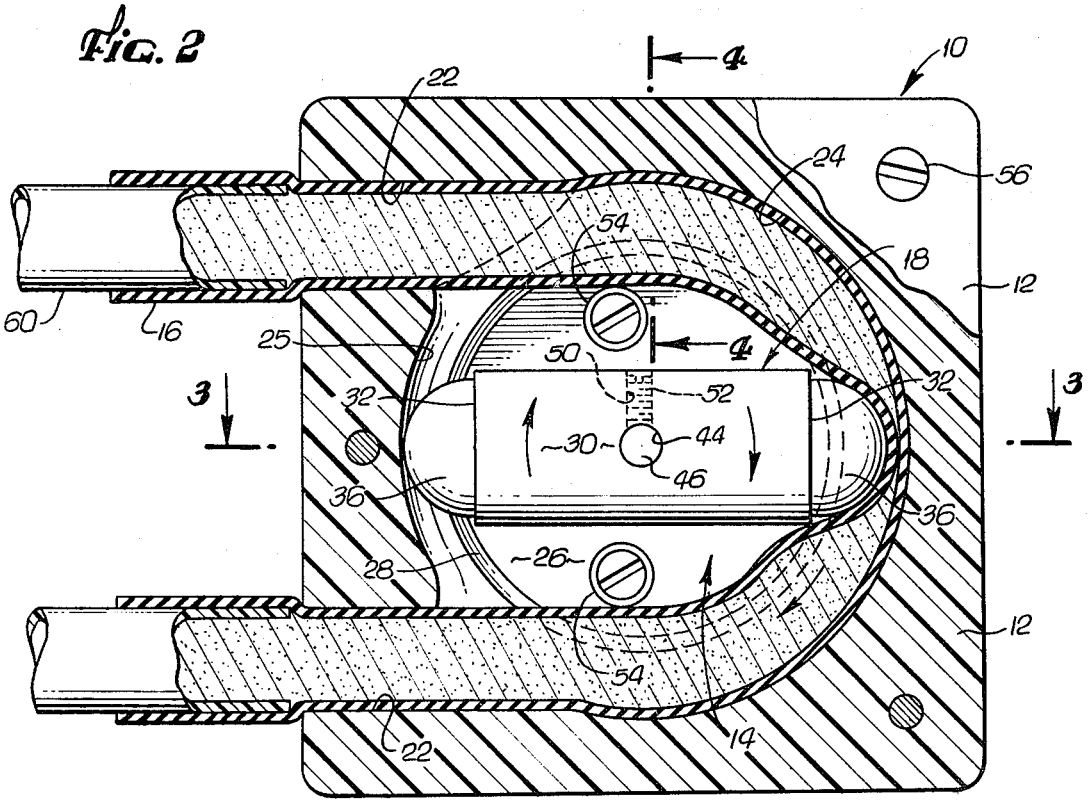
FIG. 2 is a fragmented elevational view taken along lines 2—2 of FIG. 1 of the invention depicted in FIG. 1.
Figure 3:
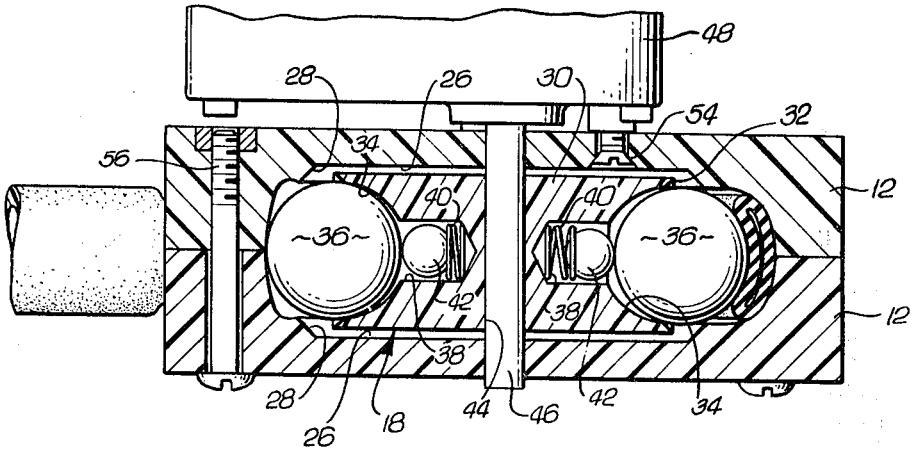
FIG. 3 is a cross-sectional view taken along lines 3—3 of the invention depicted in FIG. 2.
Figure 4:
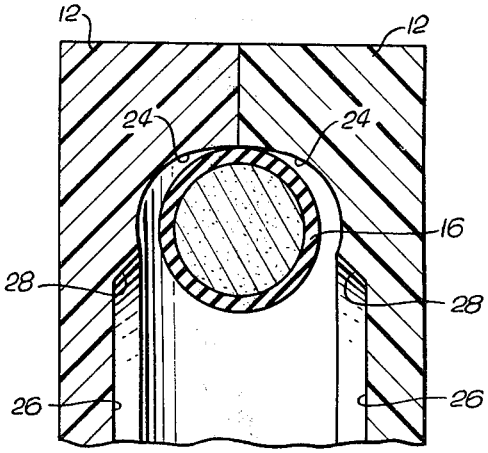
FIG. 4 is a fragmented cross-sectional view of the invention taken along lines 4—4 of FIG. 2.
Figure 5:
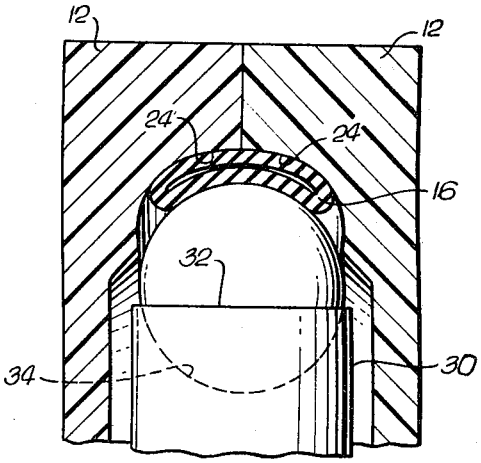
FIG. 5 is a fragmented cross-sectional view of the invention depicted in FIG. 4 showing the rotor engaging a portion of tubing.

With particular references to FIGS. 1, 2, 3, 4 and 5, a preferred example of a peristaltic pump in accordance with this invention generally comprises a housing 10 comprising facing half shells 12, a pumping cavity 14, tubing 16 and a rotor apparatus 18.

Each half shell 12 is preferably injection molded of hard polyethylene and polyvinylchloride complex, Lexan or other generally non reactive material, and a reduced shell thickness may facilitate and reduce molding costs, as in known in the art. Transparent shells 12 are preferable as they allow inspection of the condition of the internal pumping apparatus. Each half shell 12 comprises a pair of parallel longitudinal semi-circular grooves 22. The grooves 22 support the tubing 16 and provide access for inserting the tubing 16 into the pumping cavity 14.

The pumping cavity 14 is defined by a substantially semi-annular tube support grooves 24 of generally arcuate cross-section and a pair of recessed circular surfaces 26, each disposed in facing spaced apart relationship in each of the half shells 12. As viewed in FIG. 4, the semi-annular tube support grooves 24 each comprise a groove having a quarter-circle arc in cross-sectional in each of the facing half shells to provide a seat for the tubing 16 defining a nominal curvilinear tubing axis, when the half shells 12 are joined in facing relationship. The curvilinear tubing axis is disposed through the tubing 16. The longitudinal grooves 22 open up to the support grooves 24. A roller ball support groove 25 provides a rotor engaging surface in each half shell 12. The roller ball support grooves 25 are disposed in facing relationship to the tube support grooves 24 to provide a tube simulation surface. These grooves 25 are also disposed about the axis of the circular surfaces 26, about an arc of less than a half circle. The grooves 25 have a radius less than that of the support groove 24, by approximately the thickness of an occluded tubing 16. This results in support for the roller apparatus 18, to simulate the thickness of an occluded tubing to assure that there is no imbalance during rotation. A bevelled ledge 28 separates the circular surfaces 26 from the semi-annular support grooves 24 and separates them laterally to prevent creep.

The rotor apparatus 18 comprises a longitudinal cylindrical rotor 30 having opposing ends 32 and a concave semi-spherical surface 34 normal to the shaft axis at each end 32. A pair of tube engaging roller balls 36 having a radius approximating that of concave semi-spherical surfaces 34, though somewhat smaller to minimize frictional contact is disposed within each of the concave surfaces 34 at each end 32 of the rotor 30.

The rotor 30 comprises longitudinal bores 38 along the shaft axis adjacent the concave spherical surfaces 34. A spring 40 is disposed in each of the longitudinal bores 38 for biasing the roller ball 36 outwardly from the rotor 30. This allows the use of tubing of irregular tolerance without creating excessive torque on a motor drive. In the example shown, a smaller roller bearing 42 is disposed at the end of each spring 40 and is urged outward from the bores 38 engaging the roller balls 36. The smaller roller bearings 42 are allowed to rotate on the end of the springs 40, which have a diameter just a bit less than that of the smaller roller bearings 42. The diameter of the smaller roller bearings 42 is slightly smaller than that of the bores 38 so that the bearings may reside within the bores 38. Use of these smaller roller bearings 42 in combination with the springs 40 is preferred as it reduces frictional forces which would otherwise be present from the greater surface area engagement of the roller balls 36 against the semi-spherical surfaces 34 of the rotor 30. It should be recognized that the roller bearing 42 and the spring 40 need not be present for the pump to operate as lubrication may be sufficient. However, it is preferable to use the combination of the spring 40 and roller ball 42 as, in addition to reducing friction and torque on the motor, allows the use of various tubing 16 with some variation in tubing diameter.

The rotor 30 has a transverse bore 44, disposed normal and axial to the circular surface 26 for receiving a transverse rotor shaft 46 of a motor 48. A threaded aperture 50 extending normal to the transverse bore 44 and normal to the axis of the rotor shaft 46 extends through the transverse bore 44. A set screw such as an allennut 52 mating with threaded aperture 50 affixes the rotor shaft 46 of the motor 48 to the rotor 30.

Three countersunk apertures 54 transverse to one of the casing half-shells 12 are provided for rigidly affixing the housing 10 to a motor 48 or a motor mount. Housing apertures 56 are provided for joining the half shells 12 to one another.

By way of example, latex surgical tubing 16 may be used having an outer diameter of about 17 mm and an inner diameter of 10 mm. Typically the rotor 30 has a length of about 60 mm. Each roller ball 36 may have a diameter of about 20 mm.

In operation, the motor 46 is actuated causing the rotor 30 of the impeller apparatus 18 to rotate. As the rotor 30 rotates, it is retained within yet slightly spaced apart from the circular surface 26 and is prevented from climbing from the circular surface 26 by the bevelled ledge 28. The roller balls 36, however, are entrained by the concave semispherical surface 34 of the rotor 30 and by the semi-annular support grooves 24 and the inset grooves 25. Lubrication allows the roller ball 36 to freely rotate as the impeller shaft 30 is rotated independently.

Figure 6:
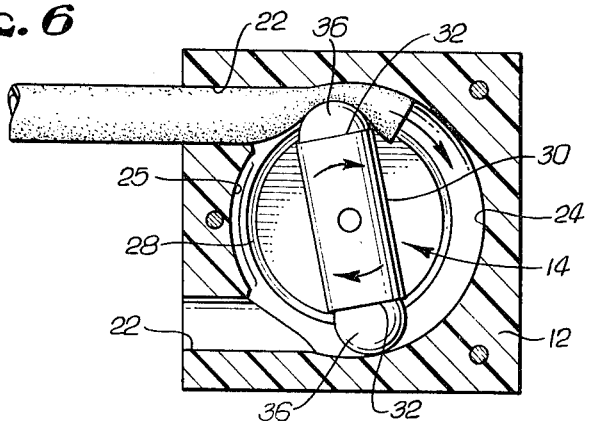
FIG. 6 is a cross-sectional diagrammatic view of the invention as depicted in FIG. 2 showing the feeding of tubing into the pumping cavity in accordance with this invention.

As shown in FIG. 6, the tubing 16 is then placed through the cylindrical access opening defined by the grooves 22 of the facing half shells 12. As the tubing 16 reaches the pumping cavity 14, it is engaged by one of the roller balls 36, thereby forcing further movement of the tubing 16 into the pumping cavity against the support grooves 24. The tubing 16 is carried around the support grooves 24 and is forced out of the opposing access aperture 22, as the free end tends to expand outwardly from the first axis of the tubing 16.

A pair of connecting tubes 60 are then disposed on the tubing 16 adjacent the access openings to communicate the pumping fluid to a source, while preventing further movement of the tubing 16, maintaining the tubing 16 within the pumping cavity 14.

As the roller ball 36 of the impeller apparatus 18 rotates, it impacts the tubing 16 after rotation within a half revolution. However, the roller ball 36, begins impacting centrally and normally to the tubing 16 and the support groove 24, causing the portions of the tubing 16 immediately adjacent the roller ball 36 to cave inwardly. This inward occlusion continues as the roller ball 36 travels about a toroidial arc defined by the rotor 30 travel. The advancement of the roller ball 36 then causes an occlusion of the tubing 16. The occlusion, however, does not create a flattening of the tube but rather a crescent shape tube closure. Rather than applying substantial forces primarily at the sides of the tubing 16, the forces are significantly directed centrally inward on the tubing 16. These forces cause a slight outward bowing on the backside of tubing 16. For this reason the semi-annular support grooves 24 have a curvature slightly greater than the tubing 16 radius prior to deformation by the roller balls 36. This is best shown diagrammatically in FIGS. 4 and 5. The movement of the roller balls 36 about its torroidial path forces liquid through the tubing 16 forwardly in the direction of torroidial movement of the roller ball 36 while creating a vacuum in the tubing 16 in the rearward region of the tubing 16 sending fluid into the tubing 16. Compressive forces on the tubing required to cause occlusion tend to be less than the forces in the ordinary peristaltic pump, thereby creating an enhanced tubing life.

Lubication may be achieved by packing a lubricant in the bores 38 prior to assembly. It may also be maintained by injecting a lubricant through the access openings 22 adjacent the tubing 16, which may then be carried by the roller balls 36 to the concave surfaces 34 of the impeller.

Part of the ability to create an effective vacuum in the rearward region is based on the resilience of the tubing 16. That is aided because tubing 16 occlusion occurs without excessive compressive forces on the tubing 16 edges. Because of this, high pumping rates can be maintained over a significant tubing life, for a given rotor RPM. The use of roller balls about the shaft cooperates so that generally only one of the roller balls has caused the tubing 16 to occlude at one time, while preventing the necessity for needing any sort of check valves.

Thus, a peristaltic pump has been provided which is reliable, easy to maintain and may be used with corrosive fluids, yet is simple and reliable in its construction.

While the invention has been particularly shown and described with reference to preferred examples thereof, it will be understood by those skilled in the art that various changes in form and details may be made therein without departing from the spirit and scope of the invention.

What is claimed is:

1. A peristaltic pump comprising:

a housing having a substantially semi-annular seat for supporting a flexible tubing;

a flexible deformable resilient tubing disposed within the annular seat and defining a curvilinear tubing axis, the tubing having an outer surface and defining an outer radius, the seat having a radius of curvature slightly larger than the outer radius of the tubing to substantially engage the outer surface of the tubing when deformed;

a rotor having opposing ends, the rotor disposed and rotatable within the housing, a semispherical concave surface at either end of the rotor, and a roller ball disposed within each concave surface, the roller ball having a convex surface about a curvilinear axis parallel to the curvilinear axis of the tubing to cause significant central tubing deformation while limiting the deformation forces exerted at the tube edges, the rotor rotatable within the housing to cause the roller ball when the rotor is rotated to impinge normal to the tubing axis to deform the central region of the tubing, moving fluid through the tubing with the movement of the rotor and creating a vacuum rearward;

means for biasing the roller ball against the tubing to compensate for small variations in tubing outer diameter; and ball bearing means for reducing rotational friction of the roller ball, the ball bearing means disposed intermediate the biasing means and the roller ball and bearing on the roller ball, the ball bearing means having a smaller diameter than the roller ball.

2. The invention as set forth in claim 1 and in which the housing comprises a pair of facing half shells.

3. The invention as set forth in claim 1 and in which the housing comprises a pair of facing recessed circular surfaces, the rotor rotatably disposed between the circular surfaces, and a circular beveled ledge surrounding each circular surface separating the circular surfaces from the annular seat, thereby providing clearance for the rotor to rotate avoiding creep of the tubing from the annular seat to adjacent the circular surfaces.

4. The invention as set forth in claim 1 and in which the housing comprises:

circular access apertures for receiving the flexible tubing; and roller ball support means for engaging one of the roller balls of the rotor when opposite the tubing, the roller ball support means opposite the seat and having a radius of curvature, the seat having a radius of curvature, the radius of curvature of the roller ball support means less than the radius of curvature of the seat.

5. The invention as set forth in claim 3 and in which:

the means for biasing the roller ball against the tubing comprises a bore disposed normal to the rotational axis of the rotor and has a spring disposed therein; and lubricant disposed within the bore for providing lubrication to the roller ball.

* * * * *